United States Patent [19]

Thai

[11] Patent Number: 5,029,355

[45] Date of Patent: Jul. 9, 1991

[54] FOLDING UTILITY TOOL

[76] Inventor: Hai Thai, P.O. Box 20554, Portland, Oreg. 97220

[21] Appl. No.: 544,747

[22] Filed: Jun. 27, 1990

[51] Int. Cl.[5] ..... B26B 11/00

[52] U.S. Cl. ..... 7/118; 7/132; 7/158

[58] Field of Search ..... 7/118, 125, 127, 132, 7/158; 81/331, 319

[56] References Cited

U.S. PATENT DOCUMENTS

| | | | |
|---|---|---|---|
| 580,235 | 4/1897 | Stum . | |
| 1,561,993 | 11/1925 | Nielsen . | |
| 4,238,862 | 12/1980 | Leatherman . | |
| 4,669,140 | 6/1987 | Miceli . | |
| 4,744,272 | 5/1988 | Leatherman . | |
| 4,805,303 | 2/1989 | Gibbs | 7/118 X |
| 4,942,637 | 7/1990 | Yeang-Yai | 7/158 X |

*Primary Examiner*—James G. Smith

*Attorney, Agent, or Firm*—Klarquist, Sparkman, Campbell, Leigh & Whinston

[57] ABSTRACT

The present invention relates to a folding utility tool having a plurality of tools which nest within the handle of the utility tool. The tool has a handle consisting of a first side and a second side spaced apart by a plurality of spacers. The area between the first side and the second side of the handle provides a first recess within the handle above the spacers and a second recess below the spacers. A pair of pivots, one on each of the handle, allow a plurality of tools to be pivoted from a nested position between the handles to an extended position beyond the handles. The tools may include such conventional devices as knife blades and screwdriver blades. At least one of the tools, however, is a pair of locking pliers having a first jaw and a second jaw pivotable about one of the pivot points. The first jaw is lockable in an extended position while the second jaw is adjustable and pivots about the same pivot point as the first jaw. An actuation lever and a reaction member provide an over-center mechanism to allow the pair of pliers to be locked in a given position with one jaw relative to the second jaw. The actuation lever has an adjustment mechanism which allows this relative position to be preadjusted for grasping various objects.

11 Claims, 3 Drawing Sheets

FOLDING UTILITY TOOL

TECHNICAL FIELD

This invention relates to a folding tool and in particular to a tool which includes in combination a knife, a pair of locking pliers and other auxiliary tools each of which may be rotated from a nested position within a handle of the tool to an extended position beyond the handle.

BACKGROUND ART

Tools are typically designed to perform a specific function. In order to perform a variety of functions, a multitude of tools would be required. Several combination tools have been devised to perform a plurality of functions. Some of these combination tools have been designed so that they will fold neatly into a small compact package.

Miceli, U.S. Pat. No. 4,669,140, for instance, discloses a folding pocket tool and knife wherein a pair of handles may also be used as pliers. Leatherman, U.S. Pat. No. 4,744,272, has also discloses a foldable tool having multiple functions. Leatherman has folding handles which when closed, enclose the jaws of a conventional pair of pliers. The extension of the handles has additional tools, such as screwdrivers, knife blades, and can openers, pivotable from these extended handles.

Other combination tools have also been devised to perform a plurality of different functions. One of these particular tools is a locking pair of pliers which uses a multiple segmented handle having an over-center mechanism to lock the jaws of the pliers at a preset position one-to-the-other. These particular pliers, however, tend to be bulky.

A need, therefore, exits for a folding utility tool having foldable tool elements such as knife and screwdriver and a folding pair of locking pliers therein.

SUMMARY OF INVENTION

It is a principal object of the present invention to provide a highly functional foldable tool which may be folded into a compact nested assembly.

It is a further object of the invention to provide a tool having locking gripping jaws which when released may be folded into a compact nested assembly.

It is still another object of the invention to provide a tool having other utility tools such as a knife which may be locked in an extended position.

The folding utility tool of the present invention provides a plurality of tools which fold into and nest within a handle. The handle has a first and a second side spaced apart by a plurality of spacers. The spacers provide a first and a second recess between the first and second side of the handle. The tools pivot on a pair of pivots, one on each end of the handle. In one embodiment of the invention a knife blade and a screwdriver blade are pivotable upon the first pivot point of the handles and nest between the first and second side of the handle when in a closed position and extend outwardly from the handle when in an open position. A locking mechanism locks the tools in the extended position and is releasable to allow the tools to rotate back into a nested position within the handles.

The second pivot on the opposite end of the handle has a pair of jaws rotatable about that pivot which nest in a second recess between the first and the second side of the handles when in the retracted position and extend outwardly from the handle when in an extended position. At least one of the jaws is lockable in the extended position such that the handle of the tool becomes a handle for one of the jaws. The second jaw has a actuation lever attached to it. The actuation lever is pivotable about the jaw so it rests parallel to and on the outside of the handle of the tool when in the nested position and is rotatable about the second jaw so that it can engage a reaction member which is pivotable on the first pivot point. This creates an over-center mechanism which allows the first and second jaw to be locked at a predetermined location.

The location of locking of the two jaws is determined by an adjustment mechanism within the actuation lever. This adjustment mechanism allows the jaws to be locked in a fully closed position where one jaw overlies the other or in any other position where the jaws are spaced apart such that any member grasped between the jaws may be held in a clamped position.

A releasing mechanism is provided for pivoting about the actuation lever to release the jaws from the locked position.

Other objects and advantages of the present invention will be apparent from the following description of a preferred embodiment thereof and from the attached drawings.

DETAILED DESCRIPTION OF THE INVENTION

Figure 2:
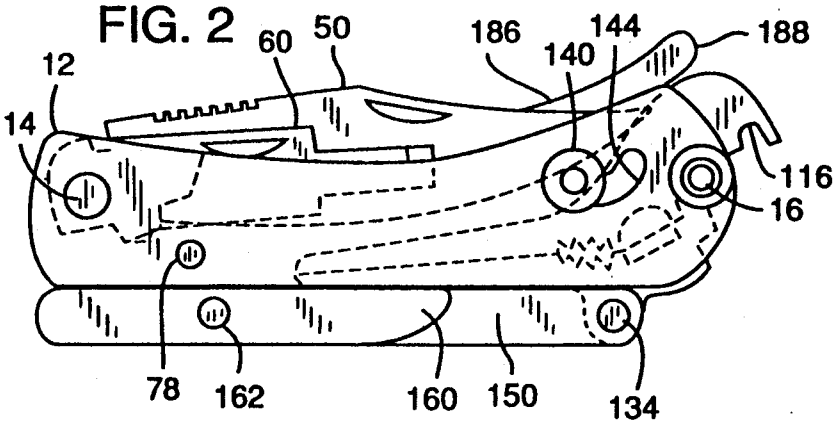
FIG. 2 is an side view of the opposite side of the folding utility tool of the present invention in the folded position.
Figure 1:
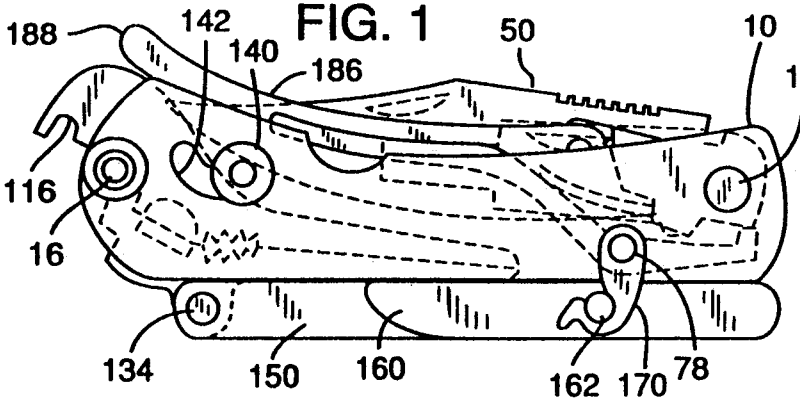
FIG. 1 is a side view of one side of the folding utility tool of the present invention in the folded position.

Referring now to FIG. 1 and FIG. 2, the folding tool of the present invention has a handle having a first side 10 and a second side 12 spaced apart from the first side. A first pivot 14 is connected to each side of the handle and a second pivot 16 on the opposite end of the handle is attached to the first side 10 and the second side 12 of the handle.

Figure 3:
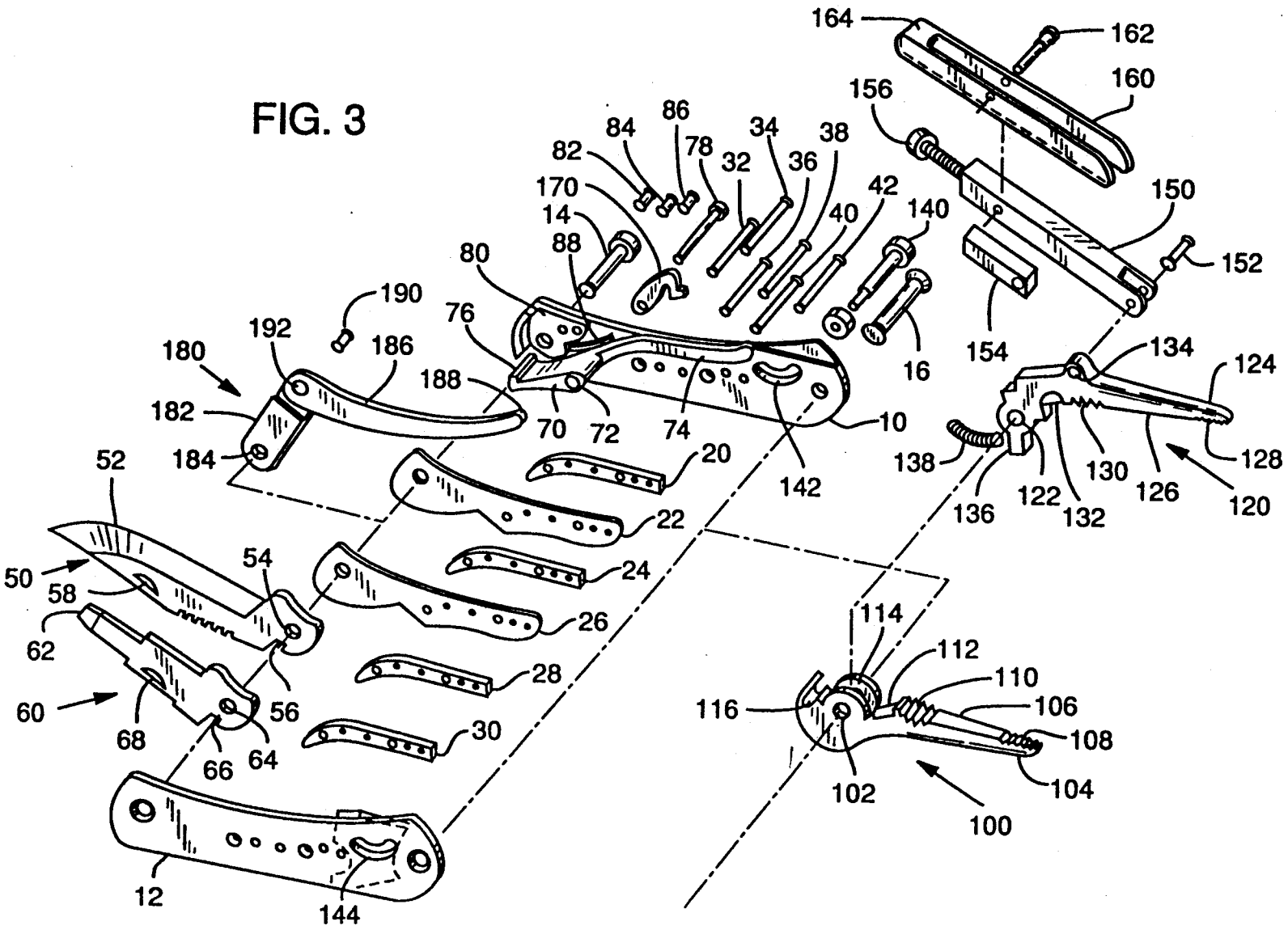
FIG. 3 is an exploded view of the components of the folding utility tool of the present invention.

Referring now to FIG. 3, the first side of the handle 10 and the second side of the handle 12 are spaced apart by a plurality of spacers 20, 22, 24, 26, 28, and 30. A plurality of rivets 32, 34, 36, 38, 40, and 42 firmly join the handle sides and the spacers together into a unitary assembly. The spacers provide a first recess between the sides of the handle and above the spacers and a second recess between the sides of the handle and below the spacers.

A first tool, such as a knife blade 50, having a cutting edge 52 is positioned between the second side of the handle 12 and one of the spacers 26. The knife blade 50 pivots on the first pivot 14 about a hole 54 in the knife blade 50. When in the closed or nested position, the cutting edge 52 of the knife blade 50 fits in a first recess above spacers 28 and 30 between spacer 26 and the second side of the handle 12. A notch 56 is provided in the knife blade 50 to lock the blade in an extended position extending outwardly from the handle as will be explained below. A finger nail depression 58 is provided in the knife blade 50 to assist in rotating the knife blade 50 from the nested position.

Additional auxiliary tools, such as the screw driver blade tool 60, may also be pivoted on the first pivot 14 to nest in the upper recess between handle side 10 and side 12. The screw driver tool 60, for instance, has a screw driver bit tip 62. Tool 60 pivots about the first pivot 14 about hole 64. When in the nested position, tool 60 occupies the upper recess on top of spacer 30. A notch 66 is located to lock auxiliary tool 60 in the extended position as will be explained below. A finger nail slot 68 is also provided in auxiliary tool 60 to assist in opening the tool from a nested position between the handle sides to an extended position beyond the handle.

Additional auxiliary tools may be placed about pivot 14 by increasing the width of the spacers 28 and 30 or adding additional spacers to compensate for the widths of the tools.

All of these tools may be locked by a common locking mechanism 70. A hole 72 is provided in locking mechanism 70 to act as a pivot point to pivot about rivet 78 which interconnects handle side 10 and handle side 12. The locking mechanism has a release arm 74 and an engagement tab 76 at the opposite end thereof.

A spring retainer 80 is riveted to handle side 10 by a plurality of rivets 82, 84, and 86. The spring retainer holds a spring 88 which forces down upon the locking lever 70 forcing the locking tab 76 in an upward position. Referring back to FIG. 1, it can be seen that a cut out exists on the top of the handle side 10 to allow a person to insert a finger nail, lifting up the portion 74 of the locking lever to rotate the locking tab 76 downward about pivot point 72 to disengage tool 50 and tool 60. In the engaged position, the tab 76 of the locking lever 70 engages the recess 56 in tool 50 and the recess 66 in tool 60, locking those tools in an extended position beyond the handle. It can be seen that the first pivot 14 extends through the handle side 10, the spring retainer 80, the spacer 22, the spacer 26, tool 50, tool 60, and then is firmly attached to the handle side 12.

Figure 4:
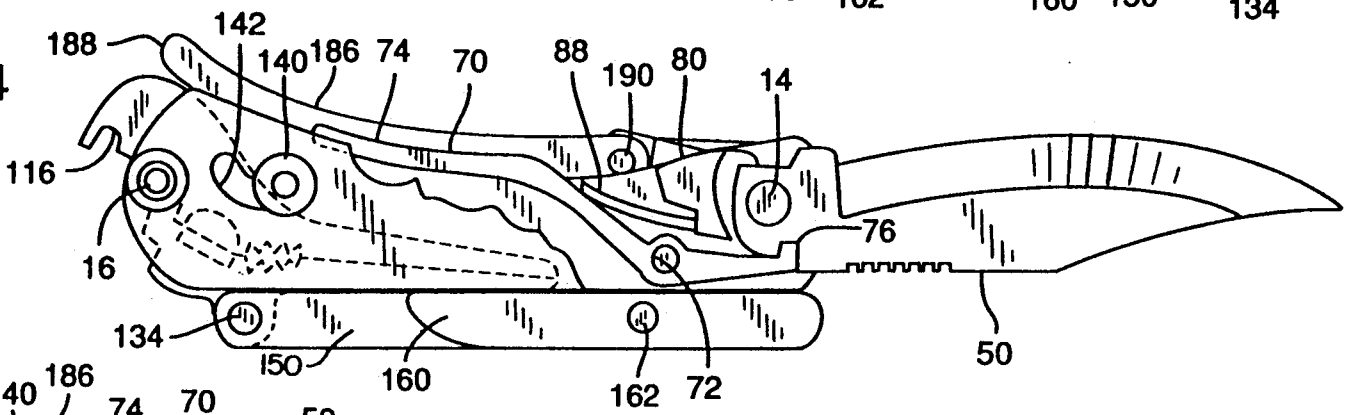
FIG. 4 is a side view of the folding utility tool of the present invention with a knife blade in the extended and locked position and one side of the handle partially broken away.

Referring now to FIG. 4, the knife blade 50 can be seen in an extended position. In an extended position, the locking member 70 is biased by spring 88 held by spring holder 80 so that the tab end 76 is forced in an upward position toward the first pivot 14. The locking tab 76 engages the slot 56 in the knife blade 50 to lock the knife blade in an extended position beyond the handles. To release the knife blade 50, the distal end 74 of the reaction member 70 is lifted in an upward position thus rotating the tab 76 downward about the pivot point 72. The knife blade 50 is then rotated about first pivot 14 to store the knife blade in a nested position.

Referring back to FIG. 3, it can be seen that at the opposite end of the handle, a pair of jaws 100 and 120 pivot about the second pivot 16 between handle side 10 and handle side 12. Jaw 100 and jaw 120 in combination form the jaws of a pair of locking pliers. The method and apparatus for locking the locking pliers will be explained below. The first jaw 100 pivots about a hole 102 on the second pivot 16. The jaw has an extended nose 104 having a plurality of serrations 108 across the surface thereof, a generally flat surface 106 on the intermediate portion, and larger serrations 110 closer to the pivot point 102. Closest to the pivot point 102 is a cutting edge 112 which may be used to cut wire or other items. The jaw 100 has an opening 114 into which jaw 120 is mounted. A cut out 116 is provided on the end opposite the distal end for locking the jaw in place in an extended position as will be explained below.

A second jaw 120 fits within the recess 114 of the first jaw 100 so that hole 122 in jaw 120 is concentric with and in alignment with hole 102 in jaw 100. Second jaw 120 has an elongated nose section 124 having serrations 128 in a distal end thereof. A flat portion 126 is in an intermediate portion of the elongated nose 124. A plurality of gripping serrations 130 is closer to the pivot 122 while a cutting edge 132 is closest to hole 122. A tab portion 136 extends below the hole 122 in jaw 120 to react against a spring 138 placed between the tab 136 and the interior portion of the first jaw 100 to spring bias the second jaw outwardly away from the first jaw 100.

Figure 6:
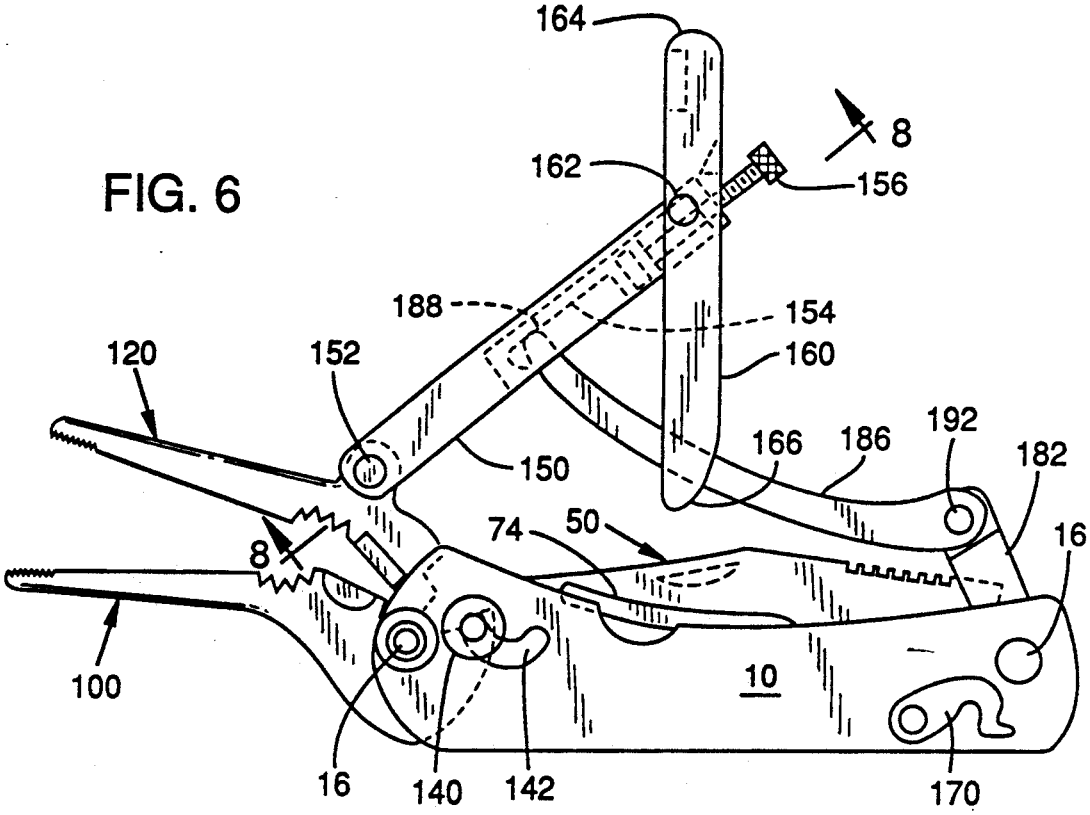
FIG. 6 is a side view of the folding utility tool of the present invention with a pair of locking pliers in the extended position with the jaws open and unlocked.

A free-floating locking pin 140 rides within a slot 142 in handle side 10 and slot 144 in handle side 12. In a normal position, when the first jaw 100 and the second jaw 120 is nested within the first side of the handle 10 and the second side of the handle 12, the pin 140 is positioned away from the pivot 16. In an extended position, both jaw 100 and 124 are extended out from the second recess between the handle side 10 and handle side 12 to extend beyond the handle. The locking pin 140 is then moved in slot 142 and 144 toward the pivot 16 and engages the recess 116 in the first jaw 100. This locks jaw 100 in an extended position as is shown in FIG. 6.

An actuation arm 150 is attached to the second jaw 120 by placing a rivet 152 through the actuation arm 150 and the hole 134 of jaw 120. Actuation arm 150 has an adjustment member 154 nested therein. Adjustment member 154 is adjusted with a threaded rod 156 having a knurled end thereon. Rotation of threaded rod 156 reacts against a threaded portion of the actuation lever 150 to force the adjustment member 154 for and aft along the length of actuation lever 150.

A release lever 160 is attached to the actuation arm 150 by means of a headed rivet 162. The release means has a first end 164 extending beyond the actuation arm 150. A second end 166 is adapted to contact the first side 10 of the handle and the second side 12 of the handle to release the actuation lever when in a locked position as will be explained below.

A reaction member 180 has a first link 182 pivotable on the first pivot 14 through hole 184. A second link 186 having an arcuate surface and a distal end 188 is attached to the first link 182 by means of a rivet 190 through hole 192 extending through both the first link 182 and the second link 186. In the nested position, the reaction member rotates about the first pivot and lies between spacer 22 and spacer 26 in a first recess above spacer 24. In the extended position, reaction member 180 is rotated about the first pivot 14 until the first link 182 contacts the spring support 80. Thus spring support 80 also acts as a stop for the extended position of reaction member 180. The distal end 188 of reaction member 180 is then inserted into the adjustment means 154. The distal end 188 forms a point to react any force applied to the actuation handle 150.

When the locking pliers are in a nested position, actuation lever 150 lies flat against the handle of the tool. A locking lever 170 pivots on a shoulder of rivet 78 and engages a shoulder on rivet 162 to hold the actuation lever 150 against the handle.

Of course, it should be understood that a wide range of changes and modifications can be made to the preferred embodiments described above. It is therefore intended that the foregoing descriptions be regarded illustrative rather than limiting, and that it be understood that it is the following claims, including all equivalents, which are intended to define the scope of the invention.

OPERATION

From a folded position as is shown in FIG. 1 and FIG. 2, the knife blade can be extended by placing one's fingernail in the slot 58 in the knife blade and rotating it about the first pivot 14 to extend the knife blade from the handle. The knife blade continues to rotate until the locking member 70 has its tab 76 engaged in slot 56 of the knife blade. This locks the knife blade in an extended position. To release the knife blade, the distal end 74 of the locking member 70 is raised out from the handle, rotating the locking tab 76 downward about pivot point 72. The knife blade is then rotated manually back to a nested position between the first side and the second side of the handle.

Auxiliary tools, such as a screwdriver blade 60, may be operated in a similar manner. That is, a finger nail is inserted into the slot 68, and the auxiliary tool blade is rotated about the first pivot 14 to extend beyond the handle. Once in a fully extended position, it is locked by engagement of the tab 76 of the locking member 70 engaging the slot 66 of auxiliary tool. Again, to release the tool, the distal end 74 of the locking member is raised away from the handle, disengaging the tab 76 from the slot 66 allowing the auxiliary tool to be rotated back into a closed position.

Figure 5:
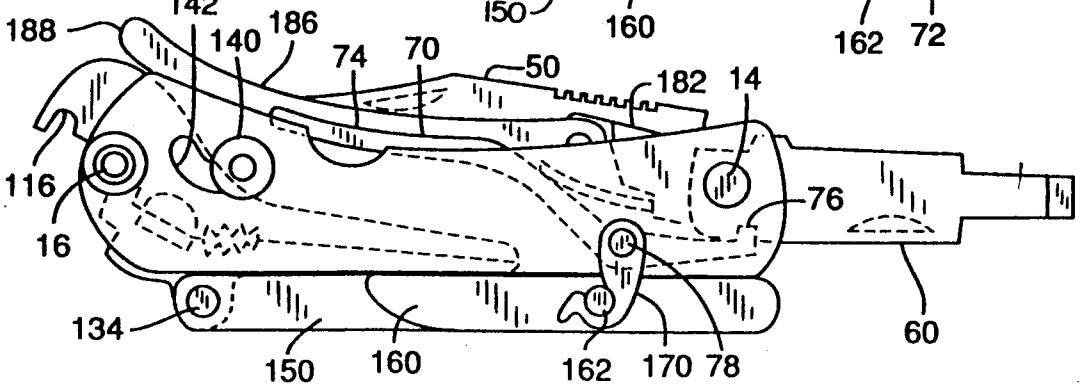
FIG. 5 is a side view of the folding utility tool of the present invention with an auxiliary tool in the extended and locked position.
Figure 7:
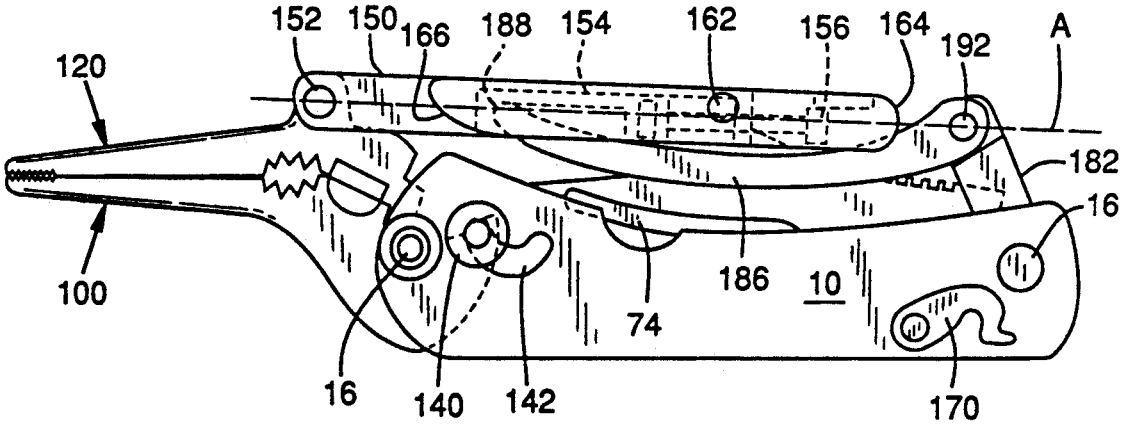
FIG. 7 is a side view of the folding utility tool of the present invention with a locking pliers in the extended position with the jaws closed and locked.
Figure 8:
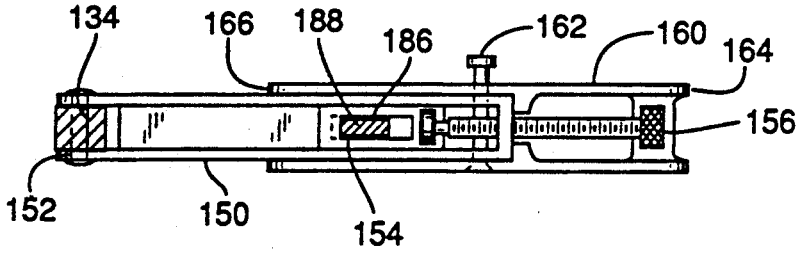
FIG. 8 is a view along lines 8—8 of FIG. 6 of the actuation lever of the locking pliers of the present invention.

Referring now to FIG. 5, it can be seen how the actuation lever 150 is locked to the handle side 10 by means of a lever 170, engaging a headed portion of pin 162. To actuate the pliers of the devise, this lever 170 is moved out of engagement with pin 162. The actuation lever is then rotated 180 degrees about pin 152 and the plier jaws 100 and 120 are rotated about the second pivot 16 to extend them beyond the handle. Jaw 100 and 120 are rotated until the slot 116 in jaw 100 is clear of pin 140. Pin 140 is then slid in slots 142 and 144 toward the second pivot 16. The first jaw 100 is then allowed to counter rotate until the slot 116 in jaw 100 engages pin 140 to lock the first jaw in an extended position outwardly from the handle. Reaction member 180 is then pushed rearward about first pivot 14 and the distal end 188 is engaged in a slot in the adjustment member 154 as is shown in FIG. 6. The release handle 160 is then pivoted about rivet 162 to expose the knurled portion of adjusting screw 156. The adjusting screw is then rotated to adjust the adjustment member 154 up and down the length of the actuation lever 150 to adjust the position of the second jaw 120 relative to the first jaw 100. The member to be clamped or held is then placed between the first jaw 100 and the second jaw 120 and a force is applied downwardly on the actuation lever 150. Continued depression of the actuation lever 150 causes the distal end 188 to be depressed below a line A shown in FIG. 7 which lies between the hole 134 of jaw 120 and the hole 190 of the reaction member 180. This is an over-center condition such that any forces tending to separate the second jaw 120 from the first jaw 100 will tend to keep the handle locked. To release the pliers from the locked position, the exterior end 164 of the release lever is raised upwardly forcing the end 166 against the first side 10 and the second side 12 of the handle of the device thus lifting the adjustment means 154 and the contact point of the distal end 188 upwardly releasing the handle as is shown in FIG. 7.

Having illustrated and described the principles of the invention in a preferred embodiment, it should be apparent to those skilled in the art that the invention can be modified in arrangement and detail without departing from such principles. We claim all modifications coming within the spirit and scope of the following claims.

I claim:

1. A folding utility tool comprising:

a handle having a first recess and a second recess therein;

a plurality of tools pivotally attached to said handle and rotatable from a nested position within said first recess of said handle to an extended position beyond said handle;

a pair of locking pliers having a pair of gripping jaws, said jaws pivotally attached to said handle and rotatable from a nested position within said second recess of said handle to an extended position beyond said handle; and an over-center means attached to at least one of said jaws for locking said jaws in a predetermined position relative to one another.

2. A folding utility tool as recited in claim 1 wherein said plurality of tools includes at least a knife blade and a screwdriver blade.

3. A folding utility tool as recited in claim 1 wherein said handle has a first side and a second side spaced apart from said first side by a plurality of spacers rigidly attached to said first side and said second side of said handle and said first recess is between said first side and said second side of said handle above said spacers and said second recess is between said first side and said second side of said handle below said spacers.

4. A folding utility tool as recited in claim 1 wherein said pair of gripping jaws include a first jaw and a second jaw wherein said first jaw is lockable in a fixed position relative to said handle when said first jaw is extended from said handle and said second jaw is movable and spring biased away from said first jaw.

5. A folding utility tool as recited in claim 4 wherein said first jaw and said second jaw have a plurality of serrations on the surface thereof for gripping objects therebetween.

6. A folding utility tool as recited in claim 4 wherein said first jaw and said second jaw each have a means for cutting a wire placed therebetween.

7. A folding utility tool as recited in claim 4 wherein said second jaw has an actuation means pivotally attached thereto bearing against a reaction means wherein said actuation means and said reaction means co-operate for rotating said second jaw about said handle.

8. A folding utility tool as recited in claim 4 further comprising:

a spring means for biasing said second jaw away from said first jaw;

an actuation means pivotally attached to said second jaw;

a reaction means pivotally attached to said handle for engaging said actuation means at an engagement point to create an over-center locking mechanism when said actuation means is depressed toward said handle to a locked position;

an adjustment means for adjusting said engagement point along said actuation means for setting the distance between said first jaw and said second jaw when said actuation means is depressed fully toward said handle; and an unlocking means for bringing said actuation means and said reaction means back over-center to release said jaws from a locked position.

9. A folding utility tool comprising:

a handle having a first side and a second side, said first side spaced apart from said second side;

a first pivot and a second pivot, said first pivot and said second pivot attached to said first side and said second side of said handle;

a plurality of tools, each of said tools pivotally attached to said first pivot and rotatable from a nested position between said first side of said handle and said second side of said handle to an extended position beyond said handle;

a pair of locking pliers having a first jaw and a second jaw, said first jaw and said second jaw pivotally attached to said second pivot and rotatable from a nested position between said first side of said handle and said second side of said handle to an extended position beyond said handle; and an over-center means attached to at least one of said jaws for locking said jaws in a predetermined position relative to one another.

10. A folding utility tool comprising:

a handle having a first side and a second side, said first side spaced apart from said second side by a plurality of spacers rigidly attached to said first side and said second side;

a first recess between said first side and said second side of said handle above said spacers;

a second recess between said first side and said second side of said handle below said spacers;

a first pivot through said handle on one end thereof, said first pivot attached to said first side and said second side of said handle;

a second pivot through said handle on the opposite end thereof, said second pivot attached to said first side and said second side of said handle;

a knife blade pivotally attached to said first pivot and rotatable from a nested position within said first recess to an extended position beyond said handle;

an auxiliary tool blade pivotable attached to said first pivot and rotatable from a nested position within said first recess to an extended position beyond said handle;

a releasable spring loaded locking means for locking said knife blade and said auxiliary tool blade in said extended position;

a pair of elongate gripping jaws said jaws including a first jaw and a second jaw, each of said jaws pivotally attached to said second pivot and rotatable from a nested position within said second recess to an extended position beyond said handle;

a locking means to lock said first jaw in an extended position to said handle;

a spring means for biasing said second jaw away from said first jaw;

an actuation means pivotally attached to said second jaw;

a reaction means pivotally attached to said first pivot for engaging said actuation means at an engagement point to create an over-center locking mechanism when said actuation means is depressed toward said handle to a locked position;

an adjustment means for adjusting said engagement point along said actuation means for setting the distance between said first jaw and said second jaw when said actuation means is depressed fully toward said handle; and an unlocking means for bringing said actuation means and said reaction means back over-center to release said jaws from a locked position.

11. A folding utility tool as recited in claim 10 wherein said releasable spring loaded locking means includes a spring held by a spring holder, wherein said spring holder also acts as a stop for said reaction member when said reaction member is in a extended position.

* * * * *